United States Patent [19]

Stivers

[11] 4,395,227

[45] Jul. 26, 1983

[54] FLAME THROWER ATTACHMENT

[76] Inventor: Scotlund Stivers, Box 60, Star Route, Bruno, Minn. 55712

[21] Appl. No.: 245,966

[22] Filed: Mar. 20, 1981

[51] Int. Cl.[3] ..... F23Q 2/00

[52] U.S. Cl. ..... 431/142; 431/255; 431/264; 431/344

[58] Field of Search ..... 431/264, 255, 91, 142, 431/344

[56] References Cited

U.S. PATENT DOCUMENTS

| | | | |
|---|---|---|---|
| 2,666,480 | 1/1954 | Peterson | 431/255 |
| 3,406,001 | 10/1968 | Ishibashi | 431/255 |
| 3,425,783 | 2/1969 | Goto | 431/264 X |
| 3,494,710 | 2/1970 | Inagaki | 431/255 X |
| 4,220,443 | 9/1980 | Bear | 431/91 |

*Primary Examiner*—Edward G. Favors

*Attorney, Agent, or Firm*—Jacobson & Johnson

[57] ABSTRACT

A flame thrower attachment for attachment to aerosol containers with the flame thrower attachment having a nozzle for discharging the combustible material, an ignition member for igniting the combustible material and a finger guard to protect the user's hand from burns.

7 Claims, 2 Drawing Figures

FLAME THROWER ATTACHMENT

BACKGROUND OF THE INVENTION

1. Field of the Invention

This invention relates generally to flame throwers and, more specifically, to a flame holder attachment for aerosol containers or the like.

2. Description of the Prior Art

The concept of flame throwers is well known in the art and usually comprises a pressurized source of flammable gas, liquid or powder. Upon activation of the flame thrower the flammable material discharges through a nozzle into the atmosphere where it is lit and burned. Typically, flame throwers are used for household purposes of burning weeds or the like.

It is known that many commercially available aerosol spray cans contain a flammable gas which can be ignited when exposed to a flame or spark. In fact, aerosol cans which have a combustible material often have a printed label to warn the user that using the aerosol cans in the vicinity of flames could be hazardous. The present invention is a flame thrower attachment for use with aerosol cans or the like that contain combustible materials. The present invention enables one to utilize the aerosol can as a small source of combustible material for a household flame thrower.

BRIEF SUMMARY OF THE INVENTION

Briefly, the invention comprises an attachment for aerosol containers or the like in which there is a nozzle for discharging a stream of flammable material, an ignition means for igniting the flammable material, a hand guard for protecting the user's hand from the flame, a housing for attachment to the aerosol spray container and a one-way valve that prevents flash back under certain operating conditions.

DESCRIPTION OF THE PREFERRED EMBODIMENT

Figure 1:
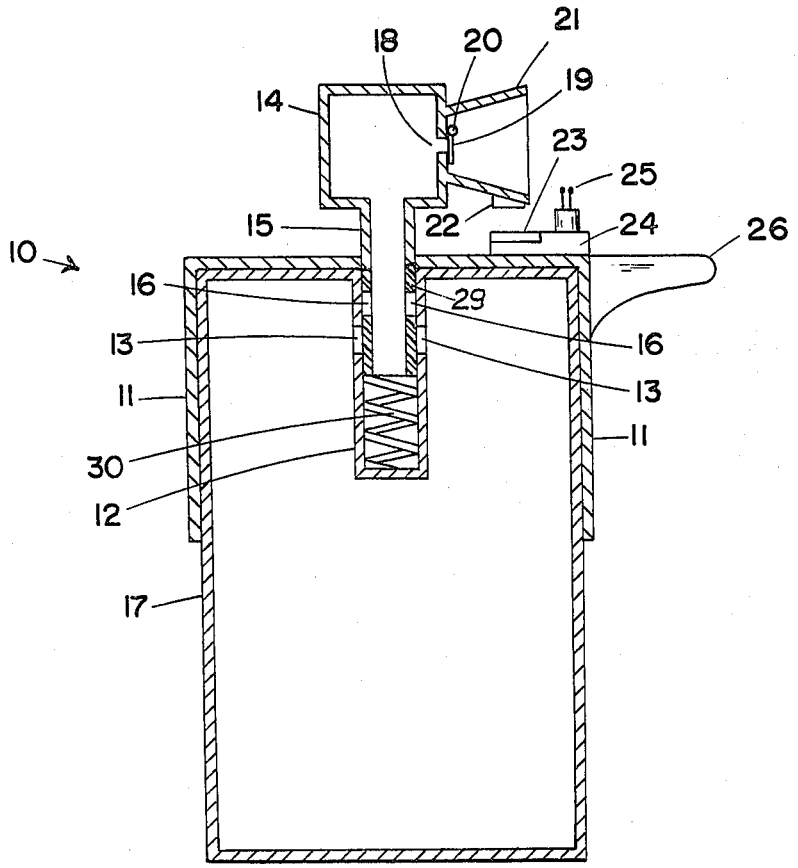
FIG. 1 shows my flame thrower attachment mounted on an aerosol container.

Referring to the drawing, reference numeral 10 generally identifies my flame thrower attachment device comprising a cylindrically shaped housing 11 which fits snugly on the exterior of a similar cylindrically shaped aerosol spray container 17. Housing 11 may be plastic or a flexible material that fits snugly over the exterior of aerosol container 17 to hold flame thrower attachment 10 in place on container 17. The fitting relationship between container 17 and housing 11 is such that housing 11 can be easily removed by pulling axially on housing 11 and on container 17 yet has sufficient holding force to prevent container 17 and housing 11 from separating under normal use. Although there are different types of aerosol containers, the basic operation of most aerosol spray containers are generally the same. Briefly, downward pressure on the top of an aerosol container nozzle, which has a tubular shank that extends into the aerosol spray can, controllably releases pressurized material in the aerosol container.

Flame thrower attachment 10 is designed for use on the typical aerosol container 17 which requires downward motion on a nozzle to release the combustible material. For purposes of illustration an aerosol container 17 is shown with one type of mechanism that is operable to release material when pressed downward. It is apparent that other aerosol container mechanisms are also suitable for use with my flame thrower attachment 10.

To understand the operation of the aerosol container 17 and flame thrower attachment 10 reference should be made to FIG. 1. Located in aerosol container 17 is an internal tubular member 12 with openings 13 therein. Located on the inside of tubular member 12 is a vertical slidable tubular member 29 having openings 16 therein. Openings 13 in tubular member 29 permit the egress of the pressurized combustible material from aerosol container 17. To illustrate how the pressurized combustible gas can be released there is shown a nozzle head 14 having a tubular extension 15 which slides within the confines of tubular member 12. FIG. 1 shows nozzle head 14 located in the up or off position. In the off position the pressurized combustible material within aerosol container 17 is prevented from discharge by the sealing engagement produced by nonalignment of the openings 16 and 13 in the coaxial tubular members 12 and 29. That is, spring 30 normally holds tubular member 29 in the up position as shown in FIG. 1. A retaining member (not shown) prevents spring 30 from forcing tubular member 29 out of aerosol container 17. Flame thrower nozzle head 14 has a tubular extension 15 which is also vertically slidable within tubular member 12 so that a downward force on tubular member 15 displaces slidable tubular member 29 downward in tubular member 15.

Located in nozzle head 14 is a discharge nozzle 18 and a one-way valve 19 that is held in a normally closed position by a spring return member 20. One-way valve 19 is preferred as a safety feature to prevent flash back or premature ignition of the flammable material in nozzle 14. However, under certain operating conditions a one-way valve may not be necessary. Located downstream of discharge nozzle 18 is a diverging section 21 for dispersing the stream of combustible material as it exhausts from discharge nozzle 18.

Mounted on the top of flame thrower attachment housing 11 is an ignition mechanism 24 comprising a piezoelectric crystal 23 having spark leads 25 projecting therefrom. As piezoelectric crystals are well known in the art, they will not be described herein except to point out that a mechanical force on the piezoelectric crystal can generate an electrical signal.

Located on the underside of diverging nozzle 21 is a contactor 22 which can mechanically contact piezoelectric crystal 23. The ignition mechanism may take the form of any type of device that provides a spark to ignite the flammable material discharging from discharge nozzle 18. For example, if the combustible material contains a flammable gas one can place a platinum black region located in the path of flammable gas. Platinum black can be used to ignite the flammable gas as a result of the heat developed by the rapid chemical combination of the flammable gas and the platinum black. Still other ignitors may employ a flint and abrading device as commonly used in cigarette lighters.

Figure 2:
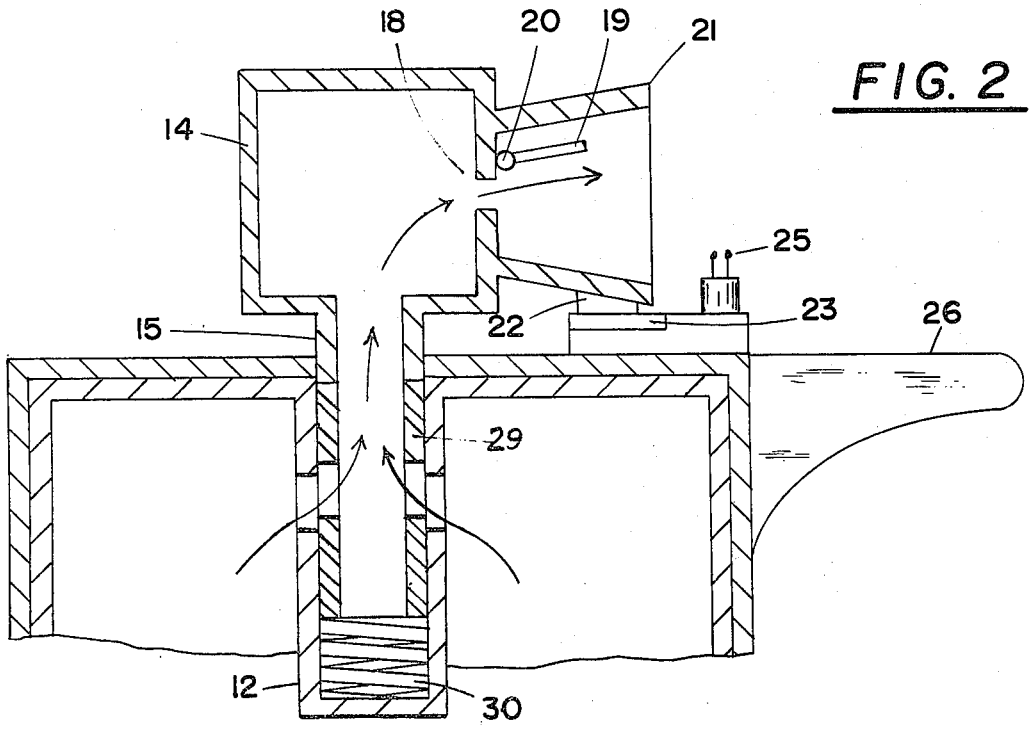
FIG. 2 shows my flame thrower attachment in the operating position.

To understand the operation of my flame thrower attachment, reference should be made to FIG. 2. Nozzle head 14 is shown located in the down or on position. In the on position spring 30 compresses downward to permit alignment of openings 16 in tubular members 29 with the opening 13 in tubular member 12. In the on position the combustible material in aerosol container 17 discharges through the aligned openings 13 and 16 and into nozzle head 14. The combustible material flows through discharge nozzle 18. The momentum of the pressurized material generates sufficient force to open one-way valve 19 to permit discharge of the combustible material through discharge nozzle 18. As the combustible material flows through diverging section 21 a portion of the combustible material flows past ignition mechanism 24. If contactor 22 is forced into contact with piezoelectric crystal 23, the force generates a spark across wires 25. The spark ignites the combustible material to produce a flame. The operator can then direct the flame at an object to be destroyed. It should be apparent that my flame thrower attachment permits an operator to use my flame thrower in a manner similar to an aerosol spray container, i.e., the operator's hand can grasp the aerosol container 17 with the hand while the finger on the same hand forces the nozzle downward.

In order to protect the user's hand there is provided a finger guard 26 which extends outward and partially around housing 11. Finger guard 16 is of a sufficient width so as to extend beyond the thickness of a user's fingers. Finger guard 26 also encompasses the area where the combustible nozzle section discharges the flammable material 21. While the present invention is shown in use with an aerosol container, it is apparent housing 11 could be adopted to screw onto other similar sources of combustible materials such as small hand-holdable propane tanks.

I claim:

1. A flame thrower attachment for use with a container of combustible material comprising:

a housing for mounting to and partially encapsulating an aerosol like container of pressurized combustible material;

a nozzle head located on said housing and adapted to connect to an aerosol like container of pressurized combustible material to permit said nozzle head to release a combustible material from an aerosol like container of pressurized combustible material, said nozzle head having an opening for directing a pressurized combustible material along an axis and a diverging section to direct a flame in a first direction;

an ignition means for igniting combustible material as it discharges from an aerosol like container of pressurized combustible material; and a finger guard attached to said housing, said finger guard having a section extending in the first direction, said finger guard located proximate but off-set from said nozzle head so that a flame issuing from said nozzle head will pass over said finger guard without burning the user's fingers.

2. The invention of claim 1 wherein said attachment includes a one-way valve to prevent back flow of combustible material.

3. The invention of claim 2 wherein said ignition mechanism comprises a piezoelectric crystal that generates an electrical spark when a force is applied thereto.

4. The invention of claim 3 wherein said nozzle head includes a vertically slidable extension for engagement and activation of a container of pressurized combustible material.

5. The invention of claim 4 wherein said housing is operable to form a friction fit with a container of pressurized combustible material.

6. The invention of claim 5 including a container of pressurized combustible material having a means for discharging combustible material into said nozzle.

7. The invention of claim 2 including platinum black to ignite the combustible material.

* * * * *